US007698983B1

(12) United States Patent
Pinto et al.

(10) Patent No.: US 7,698,983 B1
(45) Date of Patent: Apr. 20, 2010

(54) RECONFIGURABLE FIRE CONTROL APPARATUS AND METHOD

(75) Inventors: Robert P. Pinto, Dover, NJ (US); Gregory Schneck, Morganville, NJ (US); Patricia M. Alameda, Budd Lake, NJ (US); Tom Coradeschi, Hackettstown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/549,784

(22) Filed: Oct. 16, 2006

Related U.S. Application Data

(60) Provisional application No. 60/597,024, filed on Nov. 4, 2005, provisional application No. 60/746,699, filed on May 8, 2006.

(51) Int. Cl.
*F42C 17/00* (2006.01)

(52) U.S. Cl. ..... 89/6.5; 89/6; 102/275.9; 102/275.11

(58) Field of Classification Search ..... 89/6, 89/6.5; 102/301–304, 275.9, 275.11
See application file for complete search history.

(56) References Cited

U.S. PATENT DOCUMENTS 3,760,732 A * 9/1973 Schuster et al. ..... 102/215
4,144,815 A * 3/1979 Cumming et al. ..... 102/214
4,424,745 A * 1/1984 Magorian et al. ..... 102/215
4,577,561 A * 3/1986 Perry ..... 102/215
5,343,795 A * 9/1994 Ziemba et al. ..... 89/6.5
5,497,704 A * 3/1996 Kurschner et al. ..... 102/264
5,894,102 A * 4/1999 Oberlin et al. ..... 89/6.5
5,942,714 A * 8/1999 Oberlin et al. ..... 89/6.5
6,101,916 A * 8/2000 Panot et al. ..... 89/1.13
6,134,105 A * 10/2000 Lueker ..... 361/683
6,216,595 B1 * 4/2001 Lamorlette et al. ..... 102/270
6,321,654 B1 * 11/2001 Robinson ..... 102/251
6,502,786 B2 * 1/2003 Rupert et al. ..... 244/3.27
6,666,402 B2 * 12/2003 Rupert et al. ..... 244/3.27

(Continued)

OTHER PUBLICATIONS http://web.archive.org/web/20050220101038/http://www.globalsecurity.org/military/systems/munitions/m982-155.htm (used wayback machine which archives websites: http://www.archive.org/index.php) date of the archived page is Feb. 20, 2005.*

(Continued)

*Primary Examiner*—Bret Hayes
*Assistant Examiner*—Michael D David
(74) *Attorney, Agent, or Firm*—Henry S. Goldfine

(57) ABSTRACT

A portable, self-contained fire control system includes one or more of: 1) the means to provide geodetic positioning and navigational data for the host weapon platform in relation to established coordinate reference systems; 2) the means to digitally communicate with an off-platform command and control network; 3) the means to compute host platform ballistics data; 4) the means to indicate the current weapon orientation and additionally to indicate the horizontal and vertical weapon movements required to aim the weapon; 5) the means to inductively set fuzes for firing; 6) the means for digitally receiving and processing pre-computed mission data through to the fuze/projectile; 7) the means for locally computing mission data; and 8) the means for manually entering pre-computed data into the system.

6 Claims, 10 Drawing Sheets

U.S. PATENT DOCUMENTS

| | | | | |
|---|---|---|---|---|
| 6,965,816 | B2 * | 11/2005 | Walker | 701/16 |
| 6,981,450 | B1 * | 1/2006 | Adimari | 102/489 |
| 7,021,187 | B1 * | 4/2006 | Grassi | 89/6.5 |
| 7,121,210 | B2 * | 10/2006 | Steele | 102/211 |
| 7,124,676 | B1 * | 10/2006 | Lowrance et al. | 89/41.06 |
| 7,163,176 | B1 * | 1/2007 | Geswender et al. | 244/3.27 |
| 7,239,976 | B2 * | 7/2007 | Coleman et al. | 702/153 |
| 7,275,691 | B1 * | 10/2007 | Wright et al. | 235/404 |
| 2002/0117580 | A1 * | 8/2002 | Rupert et al. | 244/3.24 |
| 2003/0037665 | A1 * | 2/2003 | Rupert et al. | 89/1.8 |
| 2003/0093187 | A1 * | 5/2003 | Walker | 701/1 |
| 2004/0159261 | A1 * | 8/2004 | Steele | 102/477 |
| 2005/0126379 | A1 * | 6/2005 | Pikus et al. | 89/6 |
| 2005/0187677 | A1 * | 8/2005 | Walker | 701/16 |
| 2007/0057842 | A1 * | 3/2007 | Coleman et al. | 342/359 |
| 2008/0027663 | A1 * | 1/2008 | Anderson et al. | 702/59 |

OTHER PUBLICATIONS

Walker, Tom, Enhanced-Portable Inductive Artillery Fuze Setter (EPIAFS), Apr. 30, 2002, presented at NDIA Fuze Symposium, http://www.dtic.mil/ndia/2002fuze/walker.pdf.*

* cited by examiner

RECONFIGURABLE FIRE CONTROL APPARATUS AND METHOD

CROSS-REFERENCE TO RELATED APPLICATIONS

This application claims the benefit under 35 USC 119(e) of U.S. provisional patent application 60/597,024 filed on Nov. 4, 2005, and U.S. provisional patent application 60/746,699 filed on May 8, 2006, which applications are hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to fire control systems for munitions.

Conventional automated fire control systems for artillery and mortars are designed for specific weapon platform applications. However, these systems typically share a commonality of basic functions. These basic functions include positioning and navigational capabilities, digital communications with an off-platform Fire Direction Center, computation of ballistics, indication of the current weapon orientation in the horizontal and vertical planes, vertical and horizontal weapon movements required to aim the weapon for firing on the target, and the ability to inductively set fuzes for firing.

There are many benefits to using a single fire control system for multiple weapon platforms. Commonality of fire control lessens the burden of training gun crews. Additionally, it lowers the logistical burden by maintaining a minimal number of common parts. It also lowers the system life-cycle costs associated with hardware and software development.

Heretofore, setting of electronic inductive fuzes has been accomplished with a hand-held stand-alone setter device. Since small amounts of data were involved it was not difficult to enter the data manually into the setter. With the development of more sophisticated munitions, such as the Global Positioning System (GPS)-guided M982 Excalibur, significantly more data must be passed to the munitions prior to firing. Manual entry of this quantity of information is not practical and is error prone. To eliminate errors and expedite the process, it is desirable to have the data from the command and control center digitally transferred to the setter. This transfer of data is facilitated through or computed by the fire control system.

SUMMARY OF THE INVENTION

It is an object of the invention to provide a fire control apparatus and method that may be used with a variety of weapon systems.

It is another object of the invention to provide an apparatus and method for setting a fuze that is faster than manually setting the fuze.

Still another object of the invention is to provide a fire control apparatus that is man-portable.

It is a further object of the invention to provide an apparatus and method for setting the fuzes of precision guided projectiles.

Yet another object of the invention is to provide an apparatus and method for setting a fuze that is less prone to error than manually setting a fuze.

One aspect of the invention is a portable fire control apparatus in the form of a kit comprising a GPS receiver; a two-way radio; a power supply; a portable digital computer comprising a PIK; and a carrying case wherein the GPS receiver, two-way radio, power supply and the computer comprising the PIK are disposed in the carrying case. The apparatus may further comprise a second portable digital computer, an inductive fuze setter and an inertial navigation unit.

Another aspect of the invention is a method comprising providing a portable fire control apparatus comprising a portable digital computer; placing the apparatus at a first site adjacent a first weapon platform; and then placing the apparatus at a second site adjacent a second weapon platform, the second site being distant from the first site. The first and second weapon platforms may be the same type or different types. The fire control apparatus further includes a fuze setter, the method further comprising transferring fuze setting data from the digital computer to the fuze setter via wire.

The method may further comprise providing a projectile for firing at a target; and, after transferring the fuze setting data from the digital computer to the fuze setter via wire, transferring the fuze setting data from the fuze setter to the projectile. The step of transferring the fuze setting data from the fuze setter to the projectile may include transferring electrical power from the fuze setter to the projectile. In one embodiment, the fuze setting data and the electrical power are inductively transferred to the projectile. The fuze setting data may include one or more of a fuze detonation mode, an airburst time, an impact delay time, a proximity delay time and global positioning system data.

The method may further comprise, before the transferring step, the step of loading fire mission data into the portable digital computer. The loading step may include one or more of manual entry, computer network communication, radio communication, satellite telecommunication, wireless communication and wired communication. The fire mission data may include one or more of: choice of weapon platform; identification of the target; global location of weapon platform; global location of the target; choice of projectile; choice of propellant charge; amount of propellant charge; fuze type; fuze function; number of rounds to fire; expected muzzle velocity; muzzle velocity variation; method of control; orientation of gun tube; meteorological data; and ballistic trajectory of the projectile.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
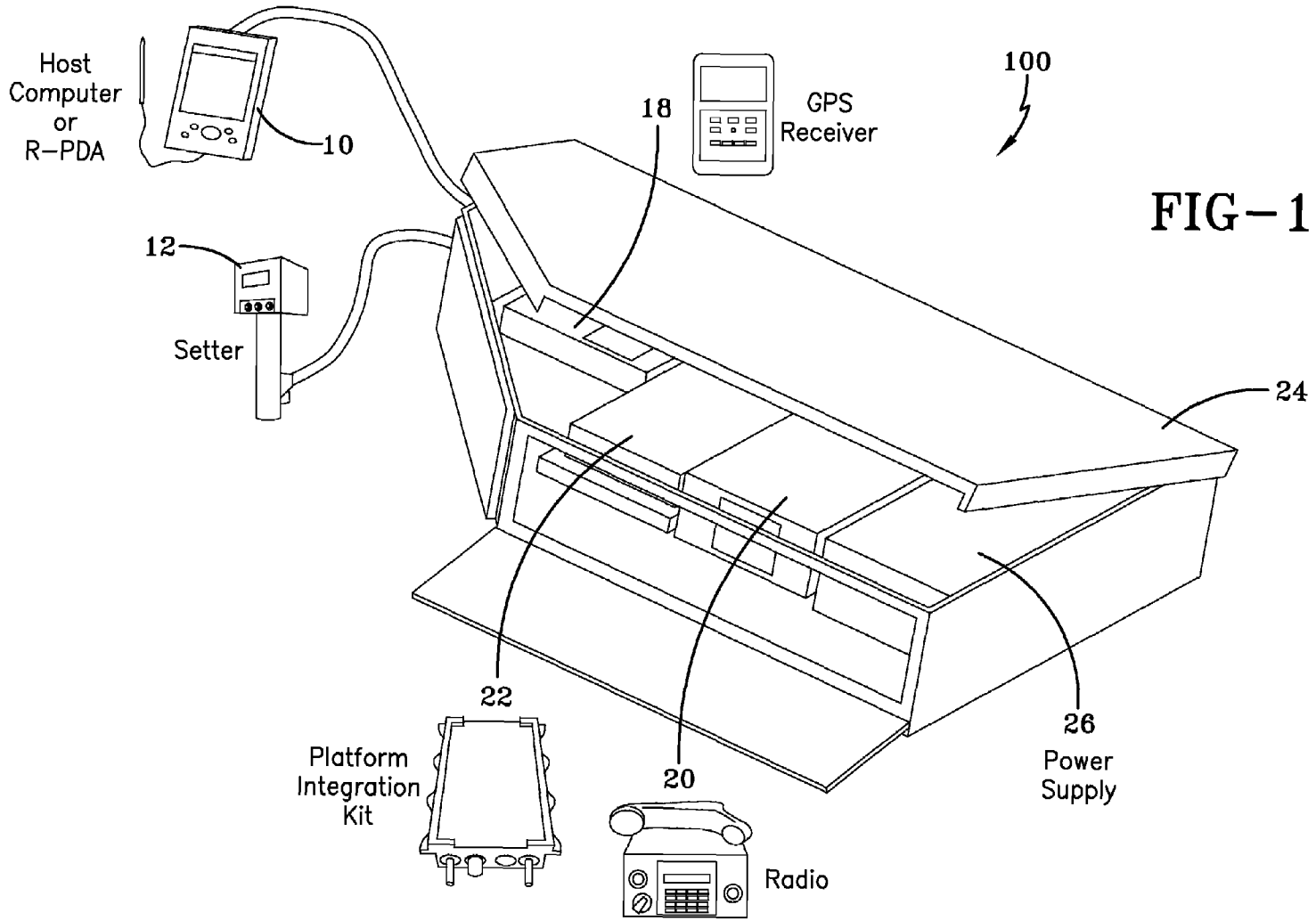
FIG. 1 shows a man-portable fire control apparatus in the form of a kit.

The following terms and definitions are used within this document:

1) Command and Control Node—A command and control node or part thereof manipulates the movement of information from source to user. This may be accomplished automatically by digital means, that is, without human intervention, or from person to person by voice means. A command and control node may communicate with a weapon's fire control system via radio or wire, or may use radio, wire, or other means to communicate by voice.

2) Fire Unit—Denotes the weapon system or platform involved in a fire mission.

3) Fire Mission (FM)—Denotes the exchange of information necessary between an indirect fire weapon platform, also known as a fire unit, such as a mortar or artillery piece, and a command and control node, such as Fire Direction Center (FDC) or other off-platform entity, necessary to fire that weapon platform against a target.

4) Fire Mission Data—Fire Mission data is the information necessary for execution of a fire mission. This may include, but is not limited to, weapon and target identifiers; three dimensional weapon and target locations, such as latitudes, longitudes, and altitudes, with respect to a common coordinate system; the type of ammunitions, propellant charge, fuze type and function, such as point detonating, delay, air burst, or time; number of rounds to fire, azimuth of fire, muzzle velocity, deflection, quadrant elevation, and a method of control, such as Do Not Load, At My Command, or When Ready. Fire Mission data is exchanged between the weapon platform and the control node or other off weapon platform subscribers by means of messages. The purpose, number of messages, and data contained in those messages includes, but is not limited to the following:

a) Mission Update to Control Node: This message is sent to provide the control node and other off-weapon network subscribers an update of the weapon's current mission progress. This information includes: Shot—rounds fired; Splash—rounds five seconds from impact; Rounds Complete—requisite number of rounds fired; Designate—lase target; Ready—ready to fire; End Of Mission—fire unit is ending the mission.

b) Command To Fire Message: This message is sent to command the weapon platform to fire.

c) Message to Control Node: This message is sent to deny mission processing.

d) End Of Mission Message: This message is sent to direct end of mission processing.

5) Support Data—Support data is the situational information necessary to support the execution of a fire mission. This data is exchanged between the weapon platform and the control node or other off weapon platform subscribers by means of messages. The purpose, number of messages, and data contained in those messages includes, but is not limited to the following:

a) Free Text Message: This message is used to allow a system operator at one node to send manually typed data to another node.

b) Check Fire Message: This message is sent to immediately stop (check) firing on a specific target, or all targets associated with the command and control network.

c) Cancel Check Fire Message: This message is sent to remove check firing on a specific target, or all targets associated with the command and control network.

d) Fire Unit Status Message: This message is sent to report the current weapon platform location, weapon operational status, and weapon capability.

6) Angular Measurement—For U.S. artillery and mortar systems, angular measurements are made in mils. A mil is the angle subtended by $1/6400$ of the circumference of a circle, where 6400 mils constitute a full circle. Other angular measurement units may also be employed depending upon the specific weapon platform.

7) Method of Lay—Method of Lay refers to the convention used to aim the weapon in the horizontal direction in order to align it to the proper angle for firing against a target. Two of the methods are: a) Bearing Method of Lay, and b) Deflection Method of Lay. Bearing Method uses an angular value that is measured from an aiming reference. The aiming reference is typically north, and the measured angle typically increases as measured in a clockwise direction. Deflection Method uses an angular offset from the initial azimuth of the weapon, or azimuth of fire. The azimuth of fire is typically measured from north and increases in a clockwise direction. That angle is called the base deflection or referred deflection, and is usually assigned a standard value of 3200 mils. The azimuth deviation from the azimuth of fire necessary to align the weapon to the proper angle for firing against a target is applied to the base deflection to compute weapon deflection as follows: Weapon Deflection=3200+Azimuth Of Fire−Azimuth To Strike Target. Deflection increases as measured in a counterclockwise direction.

8) Deflection and Quadrant Elevation Computation—When a target location is sent from the command and control node, the required horizontal and vertical firing angles for the weapon must be computed locally at the weapon platform. This computation yields a bearing or deflection, measured in a horizontal direction from a known reference azimuth, and a vertical angle or quadrant elevation, measured with respect to the horizontal. The values of bearing or deflection and quadrant elevation may also be computed off the weapon platform by the command and control node. In that case, the values may be directly sent to the weapon platform by the command and control node.

9) GPS Data—For accurate target engagement Precision Guided Munitions (PGM) may require Global Positioning System (GPS) data prior to firing. GPS data may include, but is not limited to the following:

a) Satellite Rise/Set Data—This is transmitted by a satellite and concerns when a particular satellite will be visible above the horizon. This may include the GPS time, satellite health, the satellite's azimuth and elevation, and its predicted rise and set times.

b) Almanac Data—This information is transmitted by each satellite and contains data on the orbits and health of each GPS satellite. This information allows the GPS receiver to rapidly acquire satellites shortly after it is turned on.

c) Ephemeris Data—This information is transmitted by a satellite and contains data on the current satellite position and timing information. Ephemeris data is valid for several hours.

d) Timing Date—GPS satellites contain multiple cesium and rubidium clocks. These very precise clocks are required for accurate timing of signals received by GPS receivers.

The invention relates to the art of aiming weapons, such as artillery and mortars, and the setting of fuzes for munitions. The invention includes a portable, self-contained fire control system that may be manifested in a variety of embodiments. The various embodiments include one or more of: 1) the means to provide geodetic positioning and navigational data for the host weapon platform in relation to established coordinate reference systems; 2) the means to digitally communicate with an off-platform Fire Direction Center (FDC) or command and control network for the purpose of exchanging fire mission related data; 3) the means to compute host platform ballistics data for target engagement based upon data exchanged with the FDC, weapon and target locations, and non-standard conditions, such as projectile weight, muzzle velocity, and meteorological conditions; 4) the means to indicate the current weapon orientation in the horizontal and vertical planes in relation to established coordinate references and additionally indicate the horizontal and vertical weapon movements required to aim the weapon for firing on the target; and 5) the means to inductively set fuzes for firing. In addition to processing mission data received from an external command and control source, the system may include a means for locally computing the mission data as a stand-alone system, and also a means for manually entering pre-computed data into the system.

Figure 4:
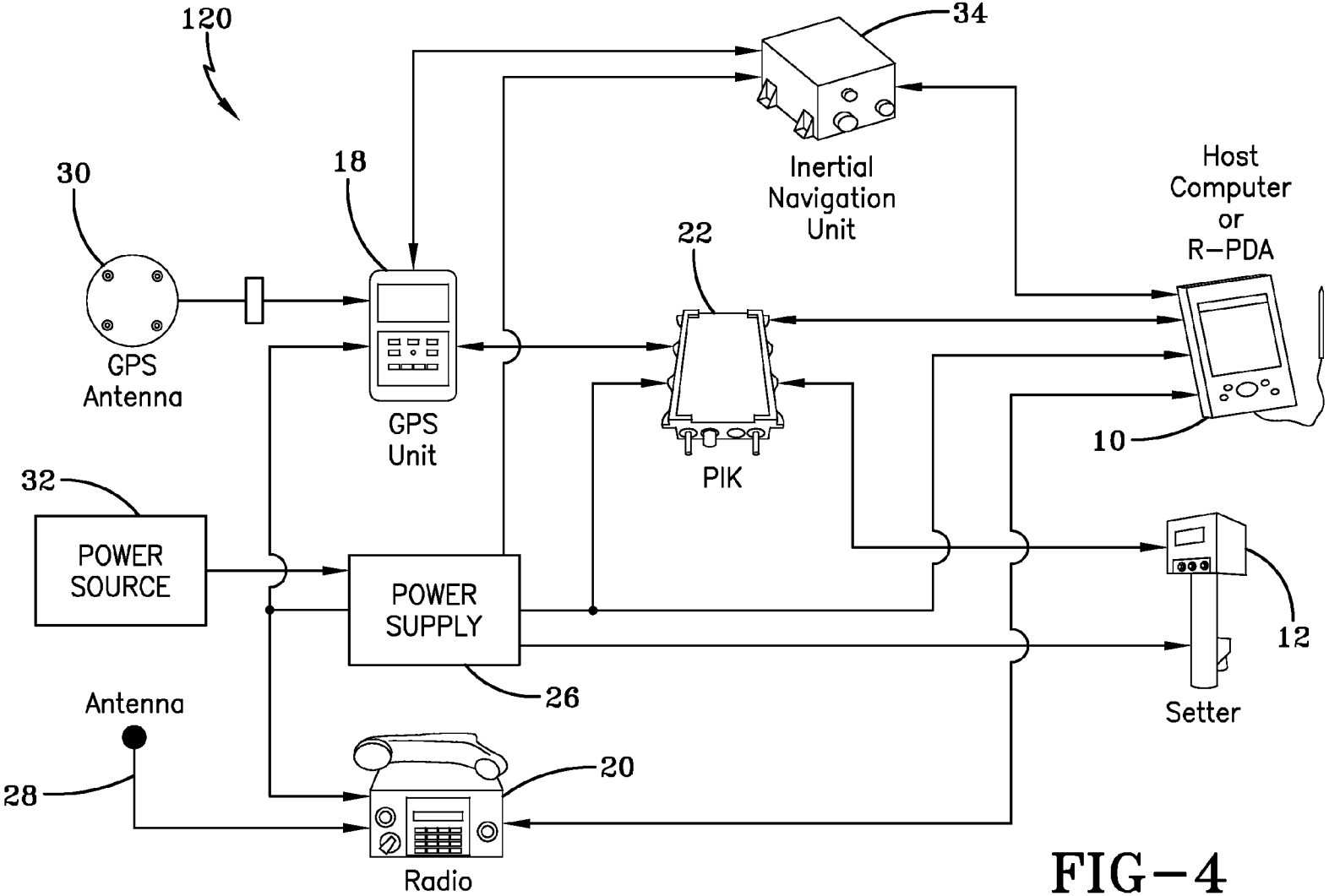

One aspect of the invention is a man-portable fire control apparatus in the form of a kit. The apparatus may be used with a variety of weapon platforms. FIG. 1 shows a man-portable fire control apparatus 100 in the form of a kit. The kit includes a portable digital computer 10 and an inductive fuze setter 12. A GPS receiver 18 may be separate from or incorporated into the computer 10. A radio transceiver 20 may be included for radio communications. A second portable digital computer, known as a Platform Integration Kit (PIK) 22 may be provided for more precise control of real-time signal processing. The function of the PIK 22 may alternatively be incorporated in the digital computer 10. In some embodiments, the apparatus 100 may also include an inertial navigation unit 34 (FIG. 4).

The portable digital computer 10 is chosen to be lightweight, portable and rugged. Computer 10 is preferably a hand-held computer, such as a personal data assistant, that includes integral input means, such as a keyboard, and an integral visual display in a monolithic case. The display is preferably responsive to a stylus or human touch (a touch screen). Optionally, the computer 10 may be a portable laptop or notebook type of computer. The apparatus 100 may be transported to a variety of weapon platforms located virtually anywhere in the world. Thus, each individual component is chosen, like the computer 10, to be lightweight, portable and rugged.

A power supply 26 may also be provided. The power supply 26 takes power from a local power source and converts it to the various types of power needed for each component. Each of the computer 10, setter 12, GPS receiver 18, radio 20, PIK 22 and inertial navigation unit 34 could have their own power supply, such as batteries, for example. However, a common power supply 26 is more convenient and reliable. Power supply 26 includes a connection for taking power from a local power source and internal circuitry for converting the local power into the various voltages and amperages needed for each component. Thus, the power supply has power connections for the computer 10, the setter 12, the PIK 22, the radio 20, the inertial navigation unit 34 and the GPS receiver 18.

Figure 2:
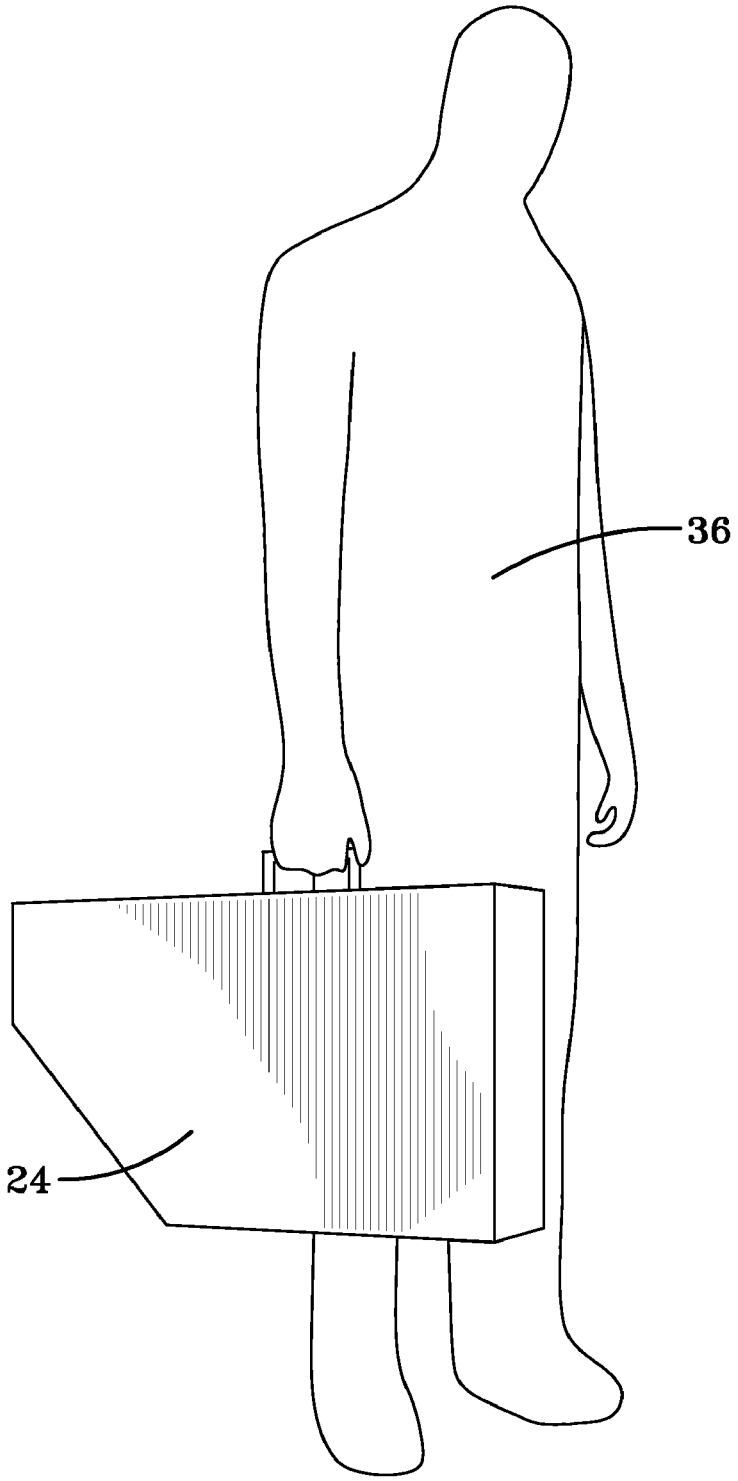
FIG. 2 shows a carrying case for the kit.

A carrying case 24 may be used to transport some of the components. FIG. 2 shows a carrying case 24 for the kit, in relation to an average sized human 36. In the embodiment of FIG. 1, the carrying case 24 carries the PIK 22, the GPS receiver 18, the radio 20 and the power supply 26. The weight of the carrying case 24 and the four aforementioned components is in the range of about 20 to about 120 pounds, preferably in the range of about 30 to about 80 pounds and most preferably in the range of about 40 to about 60 pounds. The computer 10 and setter 12 may be carried separately in their own containers. Carrying case 24 may have any shape, such as rectangular, or may be custom shaped to fit a particular area of a weapon system. In FIGS. 1 and 2, the carrying case 24 is shown with one "clipped" corner. The shape shown in FIGS. 1 and 2 is by way of example only, and not limitation.

One embodiment of the two-way radio 20 is a Single Channel Ground/Airborne Radio System (SINCGARS) advanced systems improvement program (ASIP) radio with external antenna. One embodiment of the GPS receiver 18 is a Defense Advanced Global Positioning System Receiver (DAGR) with antenna. One embodiment of the fuze setter 12 is an Enhanced Portable Inductive Artillery Fuze Setter (EPIAFS) with a power cable for connecting to the power supply 26. One embodiment of the PIK 22 is an EPIAFS PIK.

Figure 3:
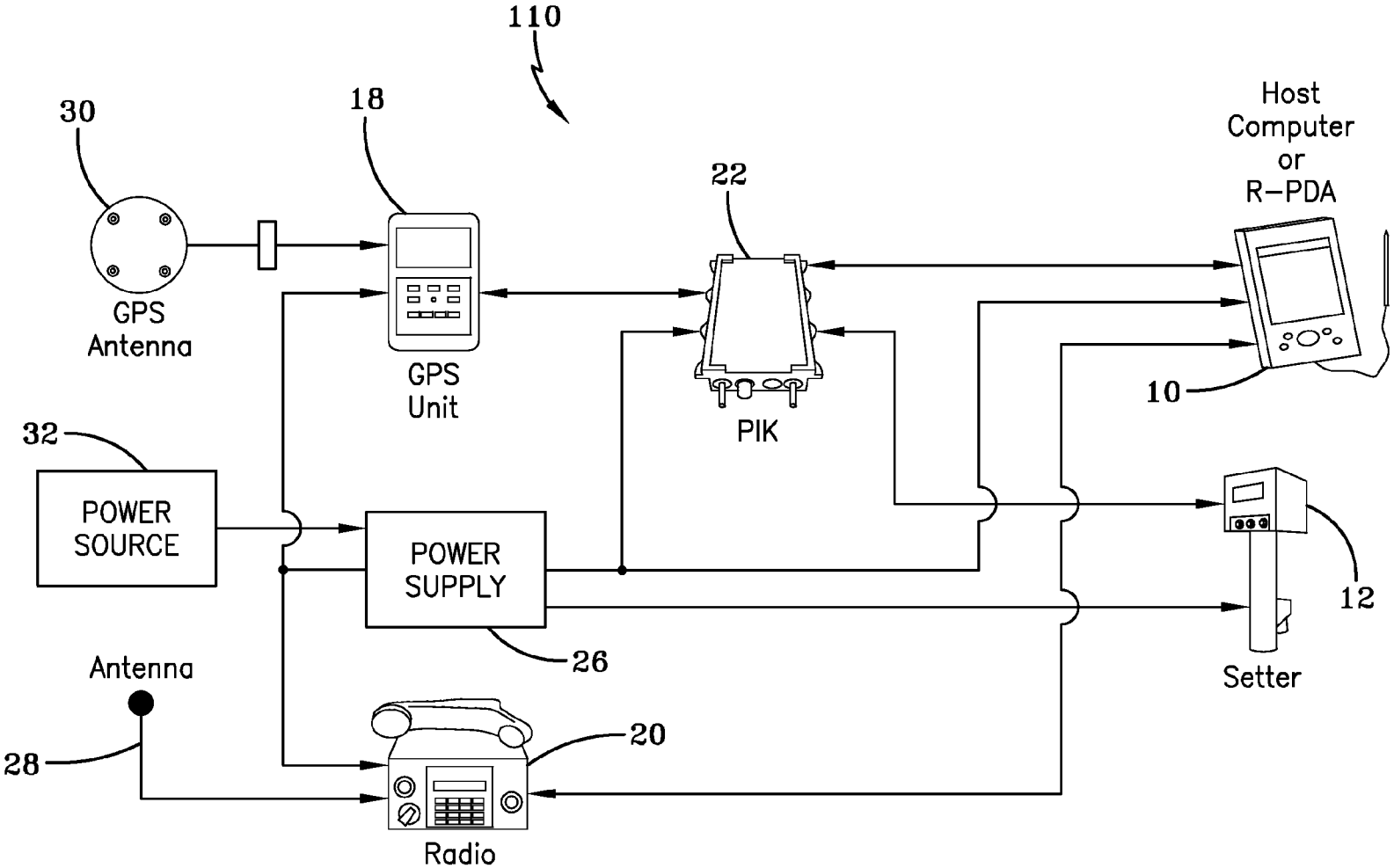
FIGS. 3-10 show eight exemplary embodiments of the invention.

FIG. 3 schematically shows one preferred embodiment of a portable fire control apparatus 110. The connections between the components in FIG. 3 are electrical connections. Apparatus 110 includes a portable digital computer 10 having an input device and a visual display; a radio transceiver 20 connected to the computer 10; a second portable digital computer 22 connected to the computer 10; a fuze setter 12 connected to the second portable digital computer 22; a GPS receiver 18 connected to the second portable digital computer 22; and a power supply 26 connected to the radio 20, the GPS receiver 18, the second computer 22, the computer 10, the setter 12 and a power source 32. The GPS receiver 18 includes an antenna 30 and the radio 20 includes an antenna 28. The second portable digital computer 22 includes the PIK.

FIGS. 4-10 shows seven other embodiments of the portable fire control apparatus. The illustrated embodiments are exemplary only and further embodiments not shown in the Figures are within the scope of the invention. The portable fire control apparatus 120 of FIG. 4 differs from the embodiment of FIG. 3 in that an inertial navigation unit 34 has been added. Inertial navigation unit 34 is connected to the power supply 26, the computer 10 and the GPS receiver 18.

Figure 5:
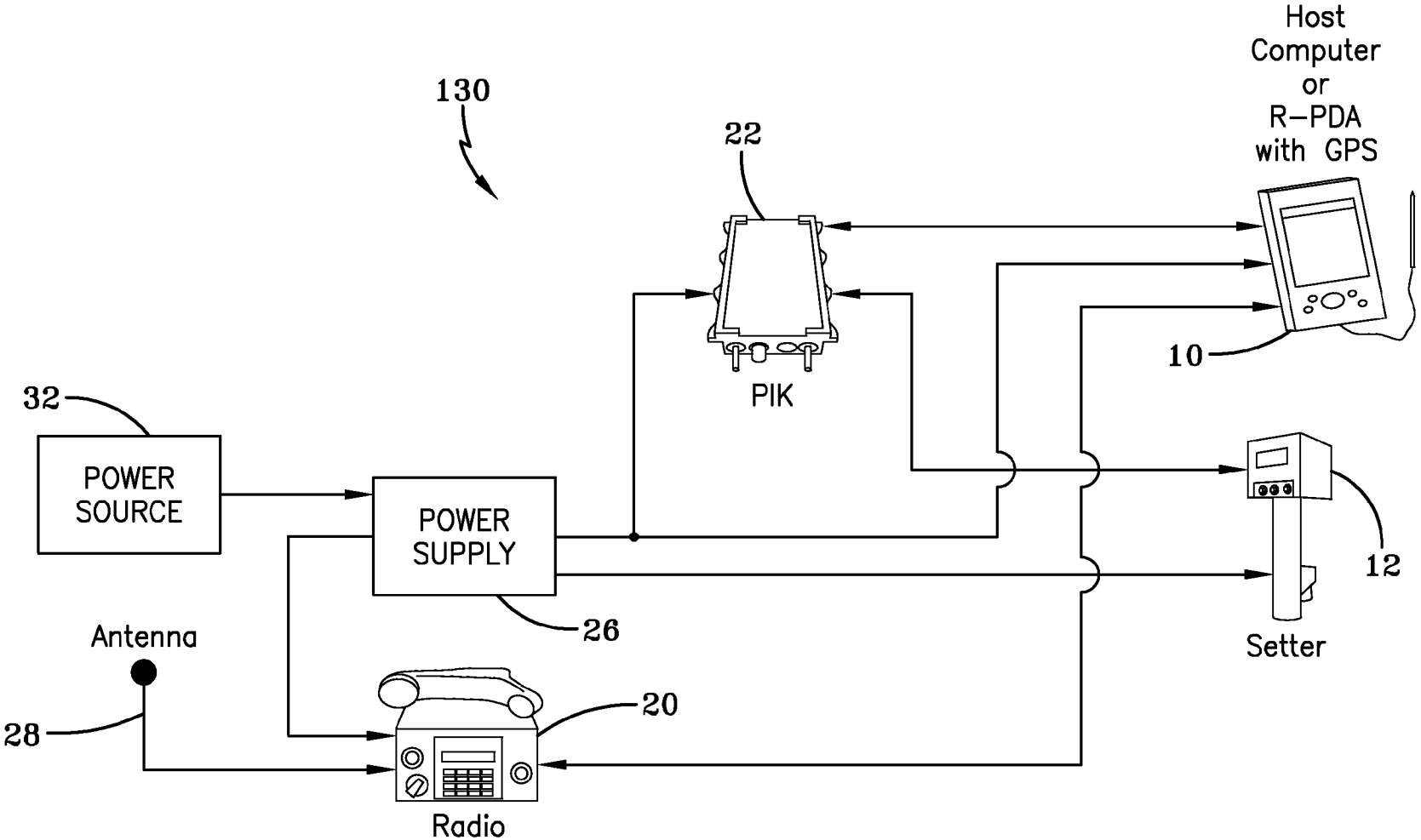
Figure 6:
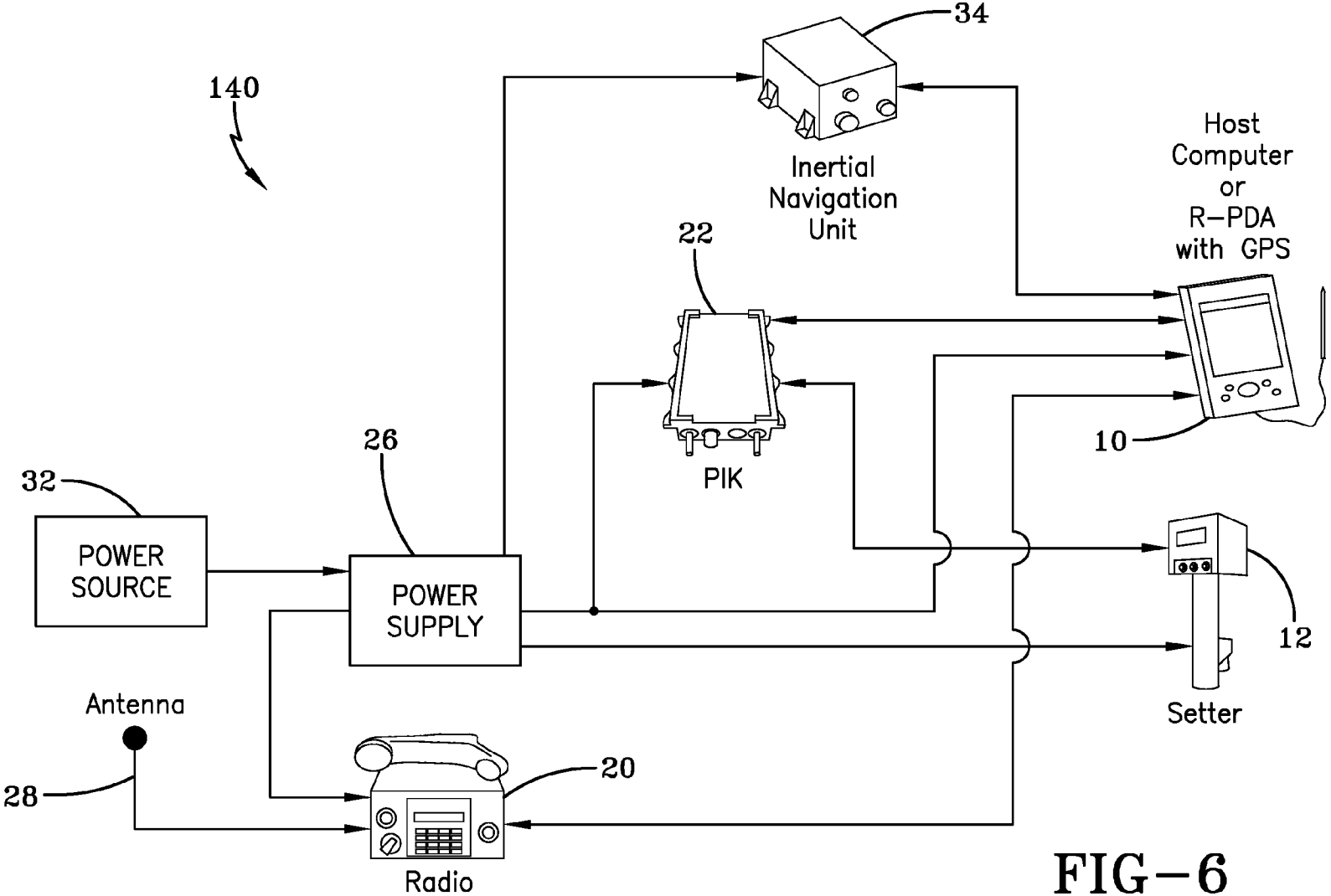
Figure 7:
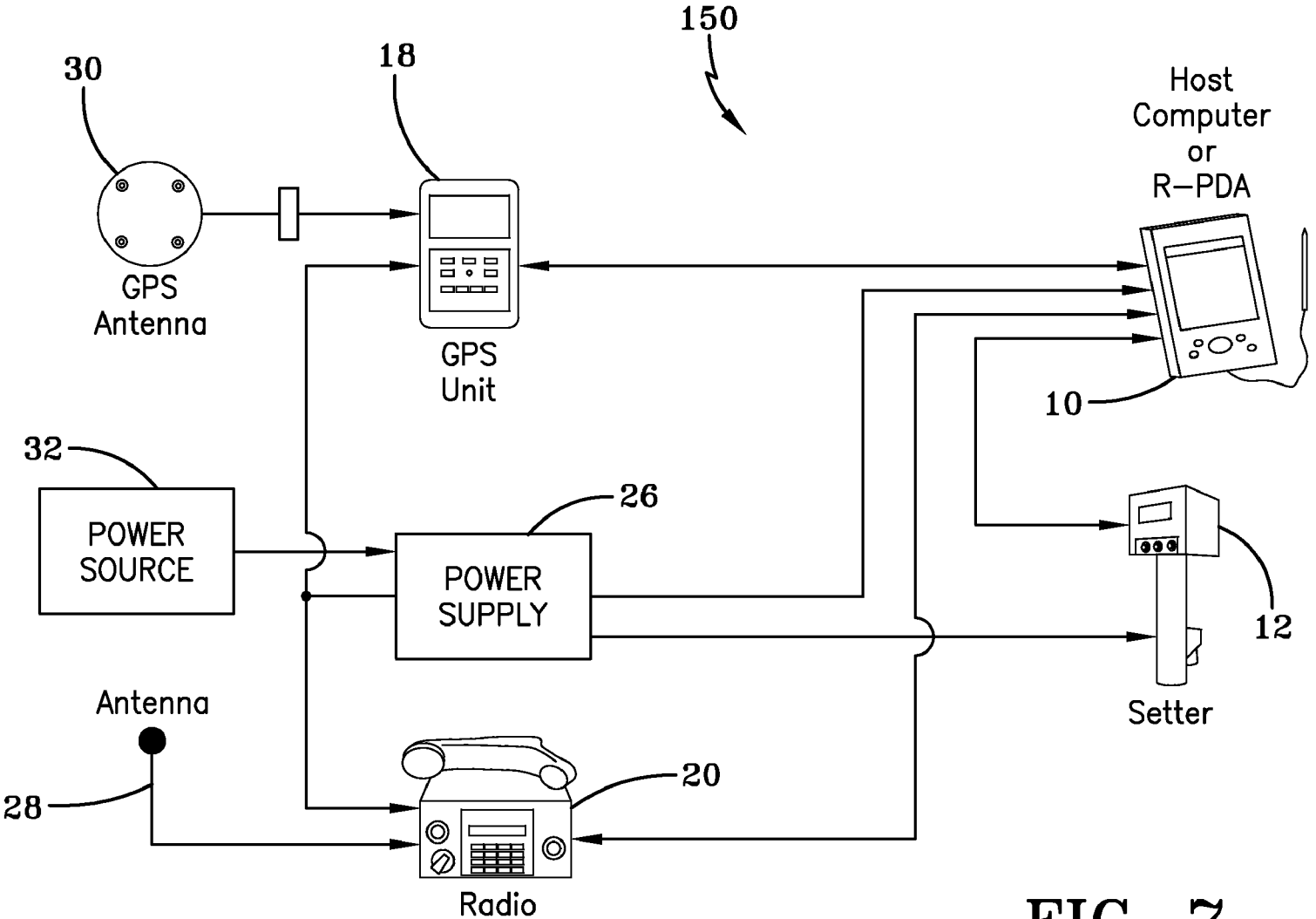
Figure 8:
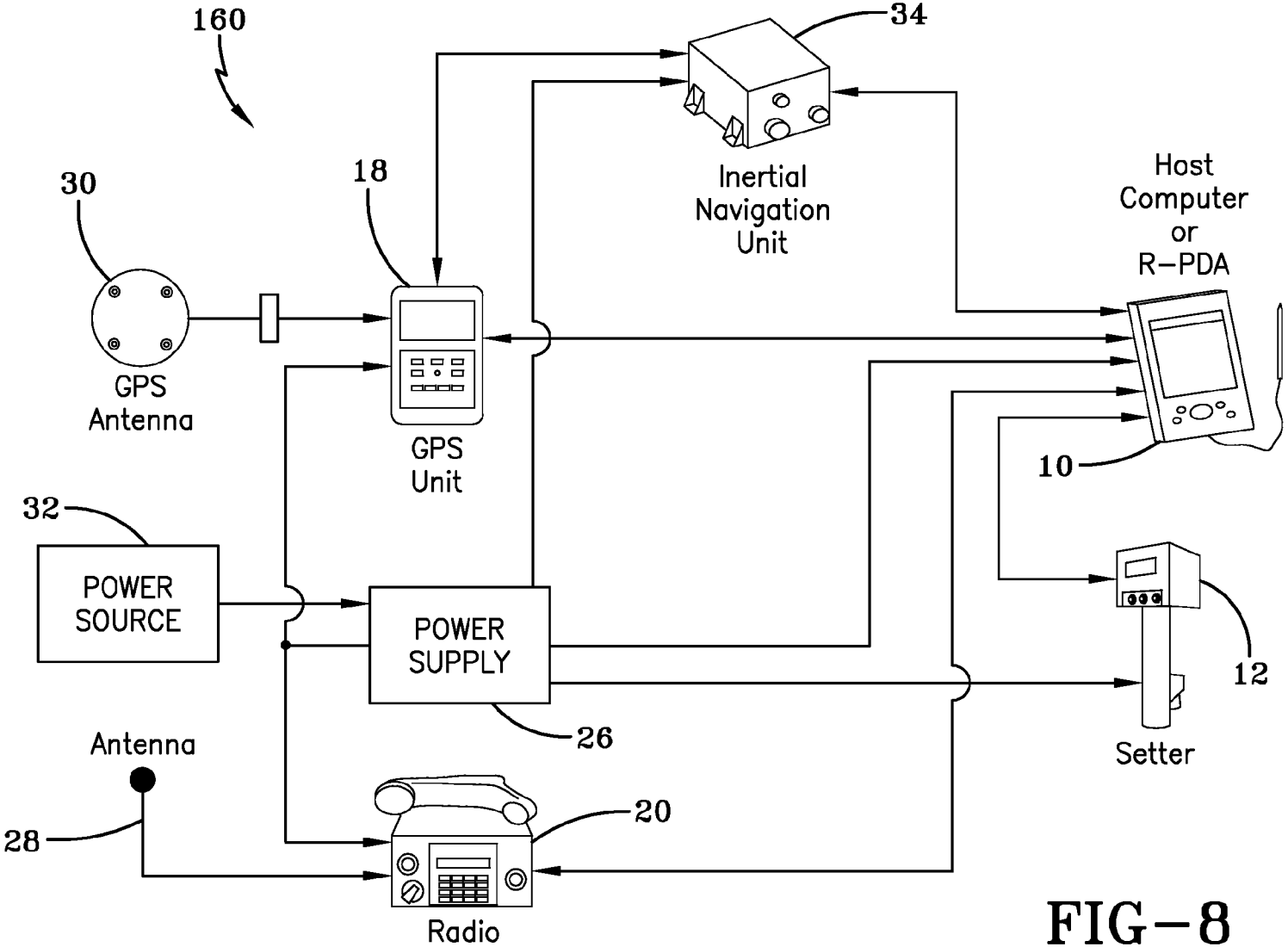

FIG. 5 shows portable fire control apparatus 130. Apparatus 130 differs from the embodiment of FIG. 3 in that the GPS receiver 18 is integral with the computer 10. FIG. 6 shows portable fire control apparatus 140. Apparatus 140 differs from the embodiment of FIG. 3 in that the GPS receiver 18 is integral with the computer 10, and an inertial navigation unit 34 is connected to the computer 10 and the power supply 26. FIG. 7 shows portable fire control apparatus 150. Apparatus 150 differs from the embodiment of FIG. 3 in that the second portable digital computer 22 (PIK) is integral with the computer 10. FIG. 8 shows portable fire control apparatus 160. Apparatus 160 differs from the embodiment of FIG. 3 in that the second portable digital computer 22 (PIK) is integral with the computer 10 and an inertial navigation unit 34 is connected to the computer 10 and the power supply 26.

Figure 9:
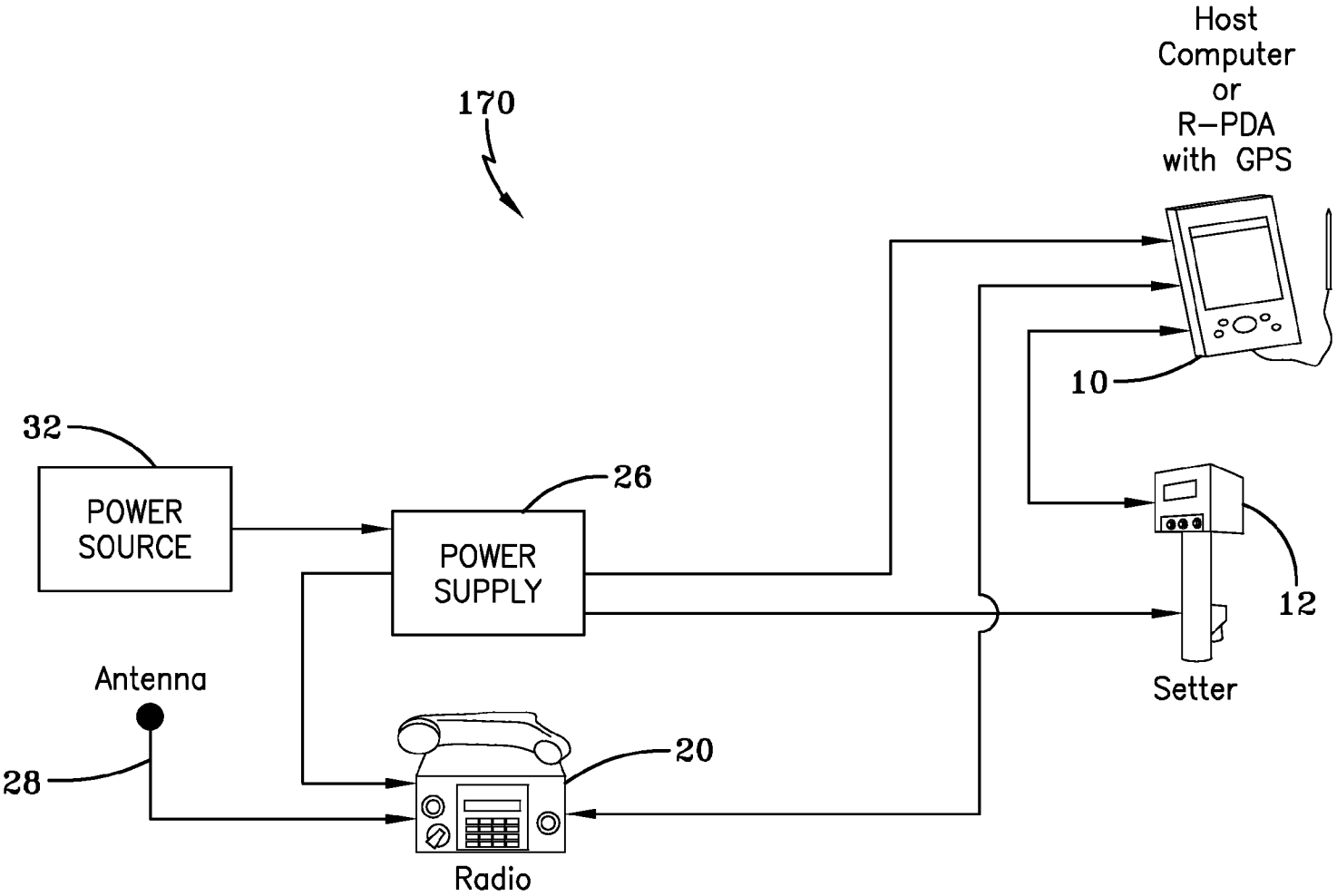
Figure 10:
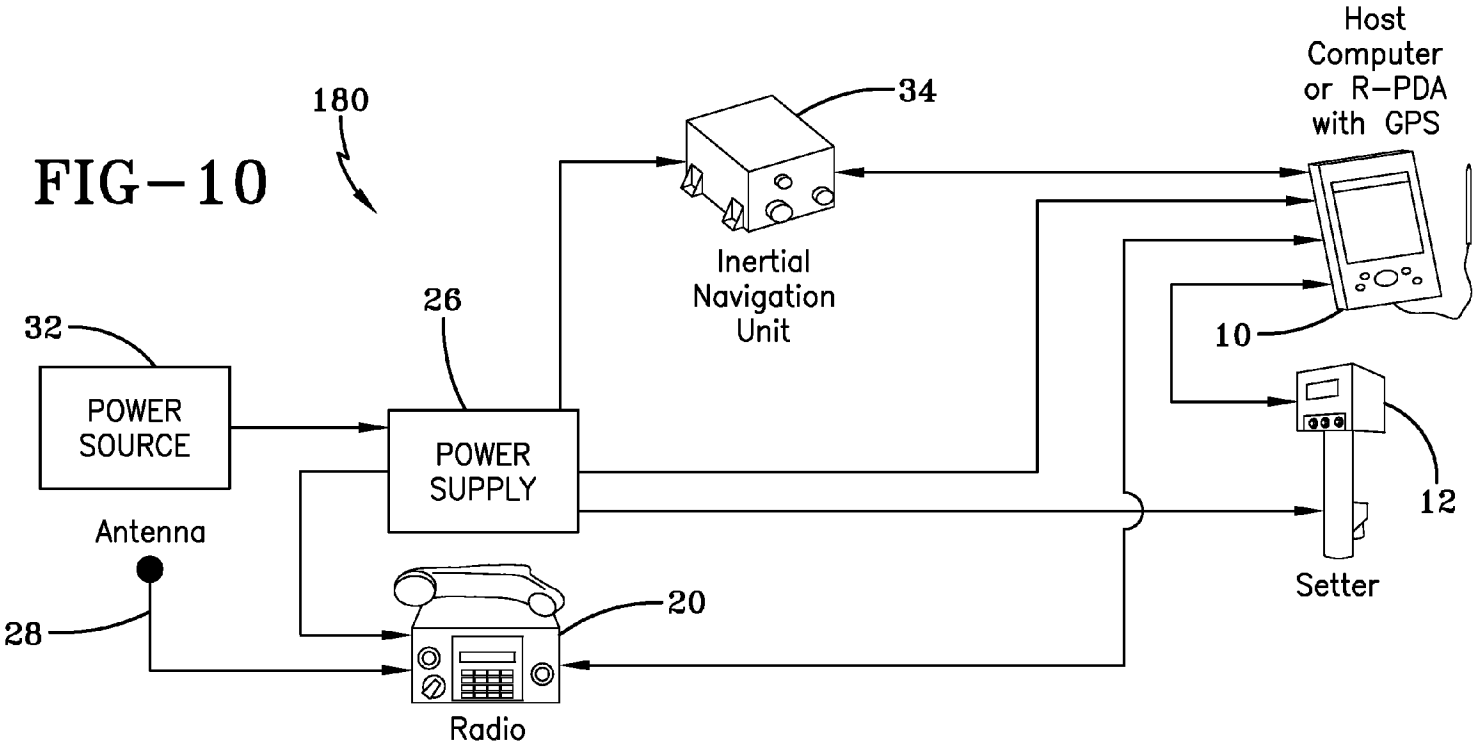

FIG. 9 shows portable fire control apparatus 170. Apparatus 170 differs from the embodiment of FIG. 3 in that both the second portable digital computer 22 (PIK) and the GPS receiver 18 are integral with the computer 10. FIG. 10 shows portable fire control apparatus 180. Apparatus 180 differs from the embodiment of FIG. 3 in that both the second portable digital computer 22 (PIK) and the GPS receiver 18 are integral with the computer 10 and an inertial navigation unit 34 is connected to the computer 10 and the power supply 26.

An important, novel feature of the portable fire control apparatus is the ability to quickly and easily move the apparatus from one location to another location. Another important, novel feature is the ability to use the portable fire control apparatus with virtually any indirect fire weapon system. With the development of precision-guided munitions, such as the Global Positioning System (GPS)-guided M982 Excalibur, significantly more data must be passed to the munitions prior to firing. Manual entry of this quantity of information is not practical and is error prone. To eliminate errors and expedite the process, it is desirable to have the data from the command and control center passively (i.e., with as little human intervention as possible) transferred to the setter. This transfer of data is facilitated through the portable fire control system.

Individual weapon systems or platforms include their own integral fire control systems. The technical sophistication of presently used fire control systems for indirect fire weapons ranges from pre-World War II vintage up to the highly sophisticated fully automated Paladin fire control systems. To effectively fire precision-guided munitions (such as the Excalibur) on this wide range of weaponry was thought to be impossible unless each weapon's fire control system was retrofitted with a new fire control system.

Supplying new fire control systems for each weapon platform is an extremely expensive proposition. While it might make some sense to do so if the retrofitted fire control systems were necessary for firing every round, the reality is that the new precision-guided rounds are very expensive and are not meant to be an "across-the-board" replacement for existing, conventional indirect fire rounds. That is, the new precision-guided rounds are for special occasions. Thus, the idea of retrofitting every weapon with a new fire control system is even less practical because, for any given individual weapon platform, the percentage of rounds to be fired that would actually require the new fire control system is low.

The inventors, however, have developed a portable fire control system that can be moved quickly and easily from weapon to weapon. The portable fire control system is especially adapted to handle the new precision-guided rounds such as the Excalibur. Therefore, virtually any indirect fire weapon, from World War II vintage up to the present, can fire rounds such as the Excalibur by using the portable fire control system of the invention. In accordance with a novel method of the invention, the portable fire control system is sited adjacent (within a few feet of) the weapon platform to be used. When a mission is completed, the portable fire control system is then moved to another weapon platform at another site that is distant (i.e., separated in space) from the first site. The weapon platforms may be of the same or different types. By way of example only, one weapon platform may be a towed howitzer and another weapon platform may be a self-propelled howitzer.

In the case of expensive rounds, such as the Excalibur, which are used on a limited basis, the invention can "follow" the rounds. Wherever Excalibur missions are ordered, the invention can follow and enable the rounds to be fired, regardless of the particular weapon platform. The invention greatly expands the capabilities of indirect fire weapons by expanding the types of rounds that each weapon platform can fire. Because the invention is portable, each weapon platform does not require its own system. Given the low cost relative to individual retrofitting, the invention will revolutionize the way indirect fire missions are planned and executed.

Figure 11:
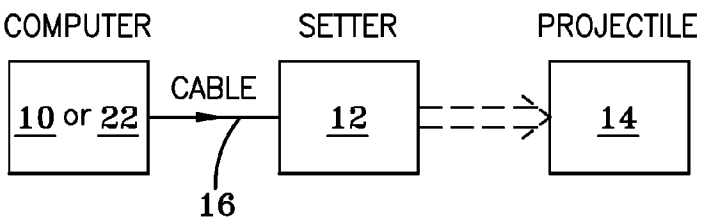
FIG. 11 is a block diagram of a portion of the invention.

As shown schematically in FIG. 11, one primary advantage of the invention is the ability to set fuzes by transferring fuze setting data from a digital computer 10 or 22 to a fuze setter 12 via a wire or cable 16. As discussed earlier, the second digital computer 22 that includes the PIK may be a separate component or may be combined with the first digital computer 10. Whether they are separate or combined, a novel step of the invention is transferring fuze setting data from a digital computer 10 or 22 to the fuze setter 12 via wire or cable 16. Transferring the fuze setting data directly from a computer into the fuze setter 12 eliminates the human error associated with manually entering data into the fuze setter 12 and, in addition, is much faster than manual entry.

After the fuze setting data is transferred to the fuze setter 12, the fuze setting data is transferred from the fuze setter 12 to a projectile 14. In this context, projectile 14 means a projectile having a settable fuze device. In addition to fuze setting data, electrical power may be transferred from the fuze setter 12 to the projectile 14. The power may be stored in the projectile 14 in capacitors or batteries, for example. In a preferred embodiment, the fuze setting data and/or the electrical power are inductively transferred from the fuze setter 12 to the projectile 14. When inductively transferring data and/or power to the projectile 14, the projectile is not chambered, and is typically located within a few feet of the launching gun or tube. In other embodiments, the data and/or power may be transferred optically or with another form of electromagnetic radiation. It is also possible to transfer the fuze setting data and/or power to the projectile 14 after it is loaded into the gun tube, utilizing a "hard" connection between the base of the projectile and the interior of the gun chamber.

The content of the fuze setting data depends on the type of projectile 14 to be fired. If the projectile to be fired is a single mode round, for example, an impact round, an airburst round or a proximity round, then the fuze setting data may comprise an impact delay time, an airburst time or a proximity delay time, respectively. If the projectile 14 contains a multi-mode fuze, then the fuze setting data will include a choice of mode in addition to appropriate time delay intervals. In the case of a precision guided round that includes an onboard GPS (global positioning system) and guidance system, the fuze setting data comprises the data for a single and/or multi-mode round and, in addition, the location (GPS) of the projectile at launch, the ballistic trajectory or launch angles of the projectile, the location (GPS) of the intended target and the most recent GPS satellite data.

The computer 10 is the entry point for information in the portable fire control apparatus. Information may be loaded into the computer 10 electronically via a wire or cable and/or manually via the computer's integral input device. Fire mission data is typically obtained from a command and control node, such as a Fire Direction Center. The computer 10 may receive fire mission data from the command and control node in a variety of ways including, but not limited to, computer network communication, radio communication, satellite telecommunication, wireless communication, wired communication, telephone modem and manual entry.

Fire mission data may include, but is not limited to, choice of weapon platform; identification of the target; the global (three-dimensional) location of the weapon platform and the target (e.g., latitudes, longitudes, altitudes); choice of projectile; choice and amount of propellant charge; fuze type and function (i.e., impact, impact with delay, air burst, etc.); number of rounds to fire; expected muzzle velocity; muzzle velocity variation; method of control (e.g., Do Not Load, At My Command, When Ready); orientation of gun tube (e.g., deflection, quadrant elevation, azimuth of fire); meteorological data (e.g., wind speed and direction, temperature); ballistic trajectory of the projectile; etc. The computer 10 visually displays the fire mission data related to preparing ammunition and firing the weapon.

The computer 10 also sends data to the PIK, which may be a separate computer 22 or part of the computer 10. The data sent to the PIK is based upon the type of fuze/projectile being fired. For example, a conventional fuze may only require a fuze type and function, whereas M982 Excalibur ammunition requires three-dimensional weapon and target locations, fuze function, azimuth of fire, and muzzle velocity. The PIK formats the data for the selected fuze or projectile 14 and transfers the fuze setting data to the fuze setter 12. In the case of guided ammunition, such as the M982, the PIK also retrieves data from the GPS receiver 18 and transfers this data as part of the fuze setting data to the fuze setter 12. The GPS receiver 18 may be a separate component or integral with computer 10.

The GPS data that is transferred to the fuze setter 12 as part of the fuze setting data may include, but is not limited to: satellite rise/set data; almanac data; ephemeris data and timing data. Satellite rise/set data is transmitted by a satellite and concerns when a particular satellite will be visible above the horizon. Satellite rise/set data may include the GPS time, satellite health, the satellite's azimuth and elevation, and its predicted rise and set times. Almanac data is transmitted by each satellite and contains data on the orbits and health of each GPS satellite. Ephemeris data is transmitted by a satellite and contains data on the current satellite position and timing information. Ephemeris data is valid for several hours. Timing data is derived from the very precise satellite clocks and is required for accurate timing of signals received by GPS receivers. Generally, the GPS location of the projectile 14 and the GPS satellite data will be acquired by the GPS 18. The GPS location of the target is generally received by computer 10 as part of the fire mission data.

Transferring the most recent GPS satellite data to the projectile 14 enables the GPS of the projectile to switch on and begin operation immediately after launch, without having to acquire and process the GPS satellite data on its own. This is an important feature because the time needed to acquire and process the GPS satellite data may be much longer than the time from launch to detonation of the projectile 14. In this way, after firing, the GPS and the guidance system of the projectile can immediately begin steering the projectile to the target.

The portable fire control apparatus of the invention may operate in three modes: passive, autonomous and manual. Compared to the autonomous and manual modes, the passive mode requires the least amount of human intervention. In the passive mode, all the fire mission data is received directly by the computer 10. "Directly received" means that manual, human input of fire mission data is not required. Computer 10 can communicate directly with the command and control node.

Compared to the passive and autonomous modes, the manual mode requires the most human intervention. In the manual mode, the fire mission data is manually entered into computer 10. The command and control node or other external source may provide the fire mission data by voice, written document, etc. Once the fire mission data is manually entered in the computer 10, the portable fire control apparatus proceeds similar to the passive mode. The major difference, apart from manual entry of fire mission data in the computer 10, is that in the manual mode there is no direct communication between the computer 10 and the control node.

In the autonomous mode, a portion of the fire mission data is received directly by the computer 10 or is manually entered into computer 10. This portion of the fire mission data may include, but is not limited to weapon and target identifiers; three dimensional target location, such as latitude, longitude, and altitude, with respect to a common coordinate system; type of ammunition, fuze and fuze function, such as point detonating, delay, or air burst; azimuth of fire; and a method of control, such as Do Not Load, At My Command, or When Ready. In the autonomous mode, the computer 10 computes the remainder of the fire mission data in a manner similar to that used at the command and control node.

The output of the autonomous mode computation may include, but is not limited to: type and amount of propellant charge; number of rounds to fire; predicted muzzle velocity; deflection; and quadrant elevation. In the autonomous mode, the computer 10 also computes the ballistic trajectory of the projectile 14. The ballistic computation may include compensation for projectile weight, muzzle velocity, propellant temperature, and meteorological conditions. Meteorological data may include, but is not limited to, range winds, cross winds, air pressure, and air pressure measurements made at various points or extrapolated to the points of the projectile's trajectory. The sensors which measure these compensating factors may be located with the weapon platform as part of its integral fire control system, or located externally to the weapon platform. After computing the remainder of the fire mission data, the computer 10 visually displays the data related to preparing ammunition and firing the weapon, and passes fire mission data to the PIK 22.

Indirect fire weapons, such as mortars and artillery, do not directly aim at the target they are firing upon. Accurate indirect fire is based upon knowledge of the weapon's location along with knowledge of how the weapon is pointed in the vertical and horizontal planes relative to a known coordinate system. The embodiments of the invention shown in FIGS. 4, 6, 8 and 10 include an inertial navigation unit 34 that provides orientation information about the gun tube. Inertial navigation unit 34 may be used with weapon platforms that lack a means for automatically sensing gun tube orientation.

For an indirect fire weapon, affixing an inertial navigation unit 34 to the weapon in such a way that it maintains a coaxial relationship with the bore of the weapon allows for instantaneous measurements of the weapon's azimuth and quadrant elevation in the horizontal and vertical planes, respectively. The orientation data of the weapon is passed to the computer 10. The computer 10 determines the weapon movements in azimuth and elevation required to aim the weapon for firing on the target. The aiming data is shown to the gun crew on the visual display of the computer 10.

A typical inertial navigation unit 34 makes use of a combination of roll, pitch, and azimuth gyroscopes; roll, pitch, and azimuth accelerometers; and the processing capability to solve a set of differential equations. The solutions to the differential equations yield outputs of velocity, position and attitude, relative to a known coordinate system and starting off from a known initial position of latitude and longitude. In place of mechanical gyroscopes, modern inertial navigation units may make use of alternative technologies, such as ring laser gyroscopes, which are better suited to the rigors of land-based systems. Additionally, inertial navigation units may be supplemented by other navigation aids to provide a higher level of accuracy than would be possible with a single navigation method. For example, the use of a GPS receiver 18 aids in bounding the position and velocity errors of the inertial navigation unit 34.

Whether the inertial navigation unit 34 is used, or a similar capability is already present in the weapon's integral fire control system, the computer 10 will visually display the required aiming data. In this regard, "aiming data" is the information needed to position the weapon for firing. As noted above, this information may be an azimuth and elevation. U.S. Army Field Manual 6-50 entitled "Tactics, Techniques and Procedures for the Field Artillery Cannon Battery" published by the U.S. Department of the Army is available on the Internet and is incorporated by reference herein. Chapter 4 of Field Manual 6-50 entitled "Laying the Battery, Measuring and Reporting" describes in detail the method used by the U.S. Army to aim indirect fire weapons.

However, other armed forces may use other methods and terminology. For the purposes of the invention, "aiming data" is the information needed to position a gun for firing, whether expressed as azimuth and elevation or in some other manner.

Once the gun crew notes the aiming data, the weapon may be moved in accordance with the aiming data. This may be done automatically, for weapons equipped with an automated weapon control system, or manually, for weapons without an automated weapon control system. If the inertial navigation unit 34 is not used and the weapon platform lacks a similar capability in its integral fire control system, then the orientation of the gun is determined by use of the conventional fire control associated with the weapon platform. Given the initial gun orientation, the computer 10 will compute and display the aiming data. However, in the absence of a computerized inertial navigation unit 34 or its equivalent, aiming the weapon is a manual, slow and error-prone process.

The portable fire control apparatus and method includes novel features that provide significant advantages over the prior art. The apparatus is easily and quickly movable from one weapon platform to another weapon platform, in contrast to the integral fire control systems of the prior art. The apparatus can be used with a wide variety of weapon platforms, in contrast to the single use fire control systems of the prior art. Although its highest functionality is demonstrated with guided munitions, the invention may be advantageously used with unguided munitions, as well.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A man-portable, reconfigurable, weapon fire control apparatus for use with virtually any indirect fire weapon system, the fire control apparatus comprising:

a two-way radio that communicates with a command and control node and receives fire mission data from the command and control node;

a global positioning system (GPS) receiver;

a digital computer connected to the two-way radio and the GPS receiver, the digital computer receiving the fire mission data from the two-way radio, the fire mission data including fuze setting data and aiming data;

a visual display device that displays the aiming data;

a Platform Integration Kit (PIK) connected to the GPS receiver and the digital computer, the PIK receiving the fuze setting data from the digital computer, the PIK formatting the fuze setting data for a fuze; and an inductive fuze setter that receives the formatted fuze setting data from the PIK and transfers the formatted fuze setting data to a fuze, wherein the digital computer comprises means for computing a ballistic trajectory of a projectile.

2. The apparatus of claim 1 wherein the digital computer includes an input device.

3. The apparatus of claim 2, wherein the input device is selected from the group consisting of a keyboard, a human touch screen, and a stylus touch screen.

4. The apparatus of claim 1 further comprising an inertial navigation unit that provides orientation data of an indirect fire weapon system to the digital computer to aid in aiming.

5. The apparatus of claim 1, further comprising a power supply that includes an input connection for receiving power from a local power source and output connections for supplying power to one or more of the GPS receiver, the two-way radio, the PIK, the digital computer and the inductive fuze setter.

6. The apparatus of claim 1, wherein the digital computer is selected from the group consisting of a laptop and a notebook computer.

* * * * *